US006199811B1

(12) United States Patent
Fargo

(10) Patent No.: US 6,199,811 B1
(45) Date of Patent: Mar. 13, 2001

(54) DEFORMABLE SAFETY HOOK

(76) Inventor: Larry S. Fargo, 983 Stevenson Rd., Ashtabula, OH (US) 44004

( * ) Notice: Subject to any disclaimer, the term of this patent is extended or adjusted under 35 U.S.C. 154(b) by 0 days.

(21) Appl. No.: 09/211,897

(22) Filed: Dec. 15, 1998

(51) Int. Cl.[7] ..... F16B 45/00

(52) U.S. Cl. ..... 248/304; 248/221; 248/226; 248/301

(58) Field of Search ..... 248/304, 226, 248/221, 301

(56) References Cited

U.S. PATENT DOCUMENTS

| | | | | |
|---|---|---|---|---|
| D. 301,406 | | 6/1989 | Barbieri . | |
| D. 361,930 | | 9/1995 | Fillipp et al. . | |
| D. 384,270 | | 9/1997 | Chang . | |
| D. 385,480 | | 10/1997 | Mayo . | |
| D. 389,399 | | 1/1998 | Bries et al. . | |
| D. 408,723 | * | 4/1999 | Goodman et al. | D8/367 |
| 740,964 | * | 10/1903 | Wintsh, Jr. | 248/304 |
| 1,335,881 | * | 4/1920 | Dottl | 248/304 |
| 1,798,768 | * | 3/1931 | Vance | 248/304 |
| 1,805,984 | * | 5/1931 | Hull | 248/304 |
| 2,275,007 | * | 3/1942 | Caestecker | 248/304 |
| 3,854,689 | | 12/1974 | Engels . | |
| 3,923,278 | | 12/1975 | Marcil . | |
| 4,027,842 | | 6/1977 | Mittleman . | |
| 4,088,292 | * | 5/1978 | Emminger | 248/304 |
| 4,170,333 | | 10/1979 | Angelastro . | |
| 4,619,430 | | 10/1986 | Hogg . | |
| 4,917,337 | * | 4/1990 | Gridley | 248/221.2 |
| 5,426,791 | * | 6/1995 | Sydor et al. | 2/255 |
| 5,553,981 | | 9/1996 | Braden . | |
| 5,881,982 | * | 3/1999 | Hollingsworth et al. | 248/220.31 |
| 6,001,471 | * | 12/1999 | Bries et al. | 428/343 |

FOREIGN PATENT DOCUMENTS

| | | | | |
|---|---|---|---|---|
| 257320 | * | 8/1926 | (GB) | 248/221.11 |

* cited by examiner

*Primary Examiner*—Leslie A. Braun
*Assistant Examiner*—Walter Landry
(74) *Attorney, Agent, or Firm*—Robert R. Hussey Co. L.P.A.

(57) ABSTRACT

A safety hook is provided for supporting an article on a structure. The hook has a base portion for mounting the hook to the structure and an article supporting portion which extends from the base portion. The article supporting portion is provided to support the article on the structure to which the hook is mounted. The hook also has an article retaining portion extending generally upwardly from the article supporting portion and operates to keep the article on the article supporting portion. The article retaining portion is formed from a material and has a configuration that allows the article retaining portion to flex and resiliently deform upon impact.

28 Claims, 6 Drawing Sheets

Section A

Section B

Section C

Section D

DEFORMABLE SAFETY HOOK

BACKGROUND OF THE INVENTION

The present invention relates in general to hooks and more particularly, to safety hooks designed to decrease the possibility of injury to persons, animals or articles hitting or impacting the hook.

Known hooks are made of stiff material or are reinforced to make them stiff for holding articles. These hooks can create injury to persons, animals or articles hitting or impacting them or even brushing against them.

Hooks are used in a variety of different locations such as on the walls in a home, school, garage, barn, horse stall to name a few. In general, hooks are mounted to fixed structures and, in some cases, to movable structures, such as sliding or overhead doors. Injury to persons, animals, or articles can occur by hitting or impacting a hook or, in the case of hooks mounted on movable structures, a hook hitting a person, animal, or article. When for example, a person inadvertently hits a hook mounted on the wall, a variety of injuries may occur. The seriousness of the injury may depend on how the hook is impacted and of course the portion of the persons body that is hit. The injury may result from the hook penetrating the person's body in a wide variety of locations which can create very serious injury.

Another example is in a horse ban where hooks are necessary for hanging halters, lead ropes, halters, lunge lines, and other tack and a variety of other articles such as brooms. If a horse runs into a hook or if the handler gets caught between the hook and the horse, either the horse or the handler may be injured. Also, a horse may inadvertently back into or hit a hook when moving around in the barn, creating substantial injury to the animal with expensive attendant medical and veterinary costs and healing expenses. Sometimes hay bales hit a hook and break it leaving a jagged edge that can cut either the handier or animal and also requires replacement of the hook. In addition, when a hook is mounted to a movable object, such as a sliding door or a garage door, when the door is moved, it may hit a person or animal causing injury. There are a wide variety of other examples were injury to person or property as a result of hitting a hook may occur.

In other instances, a person or animal moving along the wall may brush against a hook and be injured. Known hooks are not designed to withstand a horizontal or "brushing" impact force since they are designed to provide only vertical forces for holding an article. If hit in that direction in which such a hook is particularly weak, the hook may break, presenting a jagged edge that may create injuries.

Accordingly it is desirable to provide a hook that is capable of supporting an article and retaining the article on the hook while allowing the hook to flex and move upon impact. Such a hook minimizes injury to person, animals or property when hitting the hook.

It is desirable to provide a hook which balances the flexibility and strength properties of the material and the physical properties of the design of the hook to achieve the these advantageous features.

Is also desirable to provide a hook which is capable of supporting the weight of article on an article supporting portion thereof and retaining the article thereon with an article retaining portion. Advantageously, the article supporting portion is capable of supporting the weight of the article in the vertical direction and has some flexibility in the horizontal direction. Is also desirable that the article retaining portion is flexible in all directions so that when the hook is impacted, it can flex and decrease the possibility of injury.

It is also desirable to provide a hook that does not permanently bend, break or crack went it is hit or impacted.. Such a desirable hook will also have the advantageous feature of returning substantially to its original shape upon impact. Known hooks that are made from metals or plastics are prone to permanently bend, break or crack upon impact rendering the hook inoperable.

Is also desirable to provide a hook that deflects impact forces on it and does not break and have sharp edges that may create injury. By deflecting the impact force, injury is avoided as well as damage to the hook.

SUMMARY OF THE PRESENT INVENTION

The present invention provides the above described desirable features with an improved safety hook. The hook of the present invention is provided for supporting an article and is generally mounted to a fixed or movable structure.

The present invention provides a hook made from a flexible yet durable material and is designed to "give" upon impact as described herein and then return to its original shape. The hook of the present invention includes a base portion for mounting the hook to a fixed or movable structure and an article supporting portion which extends from the base portion. The article supporting portion is provided to support the article on the structure to which the hook is mounted. The article supporting portion has a combination of material strength and physical design strength in a vertical direction to support the article. The hook also has an article retaining portion extending generally upwardly from the article supporting portion and operates to keep the article on the article supporting portion.

The hook of the present invention is formed from a material and has a configuration that allows the article retaining portion to flex and resiliently deform upon impact. Such a hook minimizes injury to person, animals or property when hitting the hook. The hook is designed to balance the flexibility and strength properties of the material, and the physical properties of the design of the hook to achieve the advantageous features of the present invention.

The article supporting portion of the hook of the present invention is capable of supporting the weight of the article in the vertical direction and has some flexibility in the horizontal direction. The article retaining portion is flexible in all directions so that when the hook is impacted, it can flex and decrease the possibility of injury.

The hook of the present invention also resists permanently bending, breaking or cracking went it is hit or impacted. Such a desirable hook also has the advantageous feature of returning substantially to its original shape upon impact and will not permanently bend, break or crack upon impact. The hook also is shaped to deflect impact forces on it to further minimize injury.

DETAILED DESCRIPTION OF THE INVENTION

Figure 1:
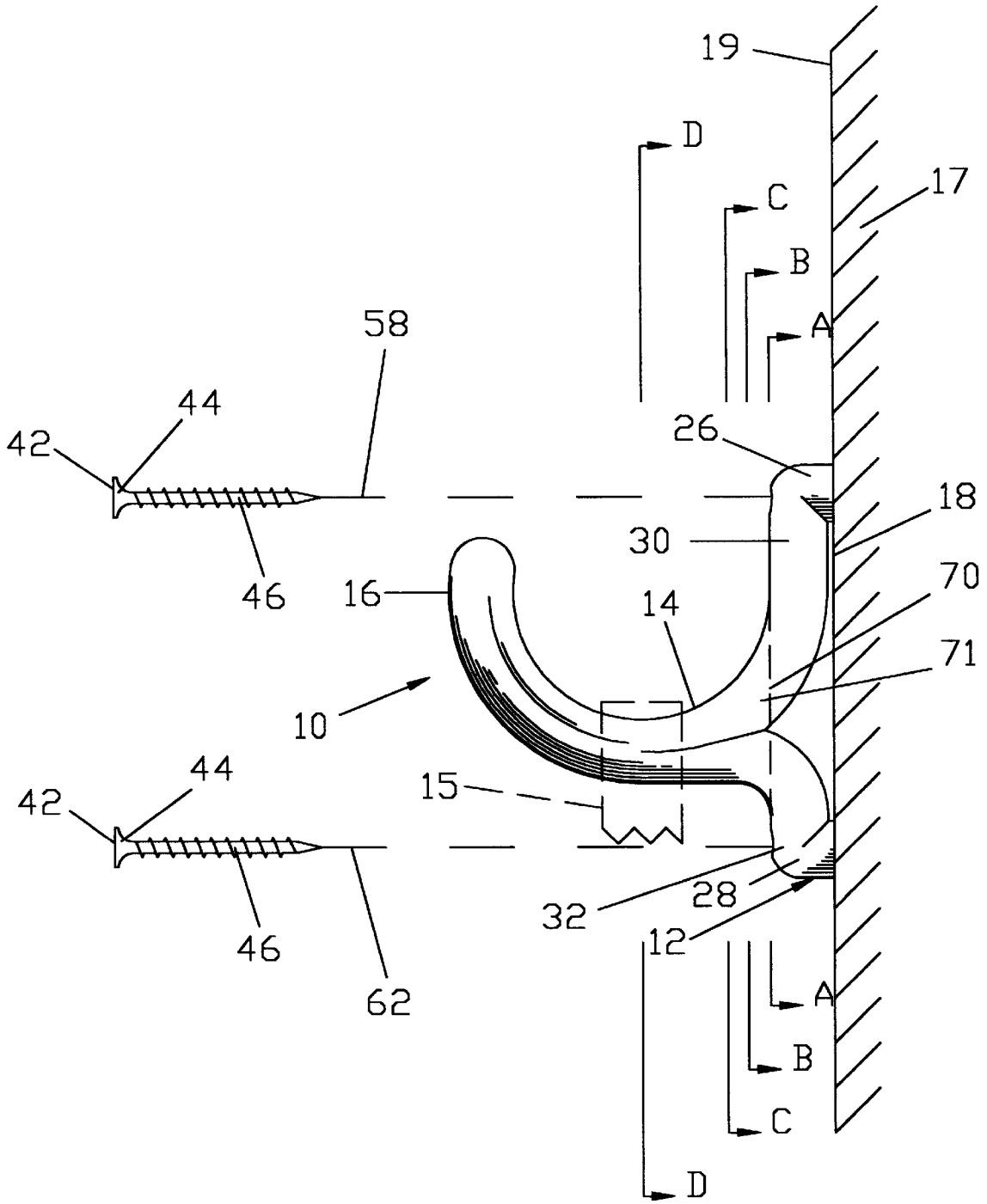
FIG. 1 is a right side elevational view of the hook of the present invention.
Figure 3:
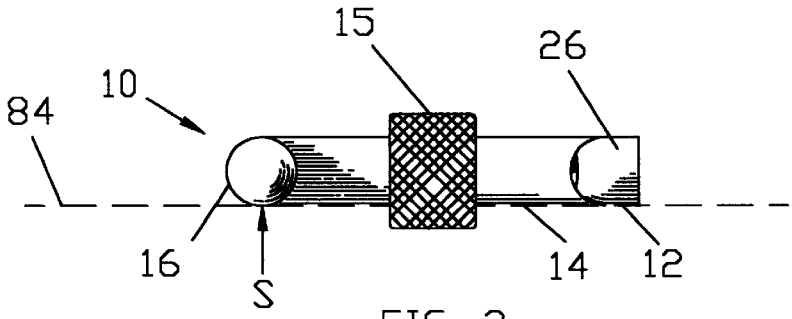
FIG. 3 is a top plan view of the hook shown in FIG. 1.
Figure 4:
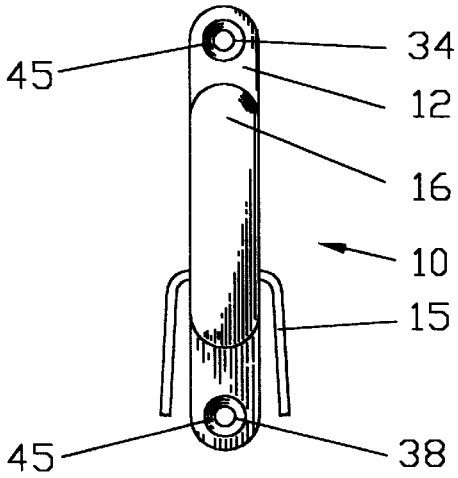
FIG. 4 is a front side elevational view of the hook shown in FIG. 1.

As shown in FIGS. 1–4, the hook 10 of the present invention has a base portion or mounting means 12, an article supporting portion or article supporting means 14 extending from the base portion for supporting an article 15 thereon, and an article retaining portion or article retaining means 16 extending from the article supporting portion 14. The base portion 12 is provided to secure the hook 10 to the structure to which the hook is to be mounted, such as the wall 17.

It should be understood that the hook 10 of the present invention may be mounted on a wide variety of fixed structures or movable structures, such as sliding or overhead doors. In fact, it is within the contemplation of this invention to configure the base portion 12 of the hook 10 to mount on structures having various shapes and designs. The articles intended to be supported by the hook 10 include for example in a barn, halters, lead ropes, halters, lunge lines, and other tack and a wide variety of other articles such as brooms. Such articles generally have a weight of from between 3 to 5 pounds. Of course, it is within the contemplation of this invention to support articles of a wide variety of weights dependant on the dimensions and configuration of the hook.

Figure 2:
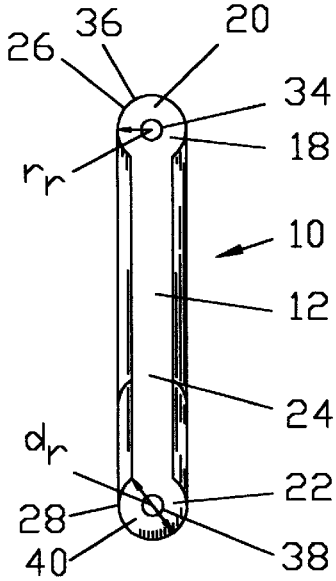
FIG. 2 is a rear elevational view of the wall hook shown in FIG. 1.

The base portion 12 has a support surface 18 that lies in the plane 19 of the wall 17 and has upper and lower securing support surfaces 20, 22 and a central support surface 24 extending between the upper and lower securing support surfaces as shown in FIG. 2. The upper and lower securing support surfaces 20, 22 provide a generally enlarged area to allow for better distribution of the forces required to keep the hook 10 mounted to the wall 17 as will be hereinafter more fully described.

As seen in FIGS. 1–4, the base portion 12 has upper and lower base reinforcing portions or braces 26, 28 extending away from the support surfaces 20, 22 respectively and terminating in the upper and lower reinforcing portions or ribs 30, 32 respectively of the base portion 12. The upper and lower base reinforcing braces 26, 28 form the upper and lower securing support surfaces 20, 22, respectively. An aperture 34 is provided through the top 36 of the base portion 12 and extends through the upper base reinforcing brace 26 and the upper reinforcing rib 30. An aperture 38 is provided through the bottom 40 of the base portion 12 and extends through the lower base reinforcing brace 28 and the lower reinforcing rib 32.

As shown in FIGS. 1–5, fasteners 42 are provided to be inserted into the upper and lower apertures 34, 38, respectively so they may threadedly engage the wall 17 and accordingly secure the base portion 12 to the wall 17. After the fasteners 42 are inserted into the upper and lower apertures 34, 38 they are screwed into the wall 17 and as the base portion 12 moves toward the wall, the support surface 18 of the base portion comes into contact with the wall and is tightened thereto. The holding force created by the tightened fasteners 42 is distributed over the upper and lower securing support surface is 20, 22 and the central support surface 24.

The holding force between the fasteners 42 and the hook 10 is spread over an area of the hook allowing greater forces therebetween without the fasteners 42 being pulled out of the apertures 34, 38. The head 44 and the shank 46 of the fastener 42 is shaped to spread the holding force over an area of the apertures 34, 38, by forming the apertures with a conical shape 45 tapering to mate with the head 44 of the fasteners 42. It should be understood that other constructions and designs may be utilized to distribute the holding force between the fastener 42 and the hook 10.

The upper and lower base reinforcing braces 26, 28 have a generally circular cross-section and extend in a direction vertical to, and away from the support surface 18. The upper and lower reinforcing ribs 30, 32 have a generally circular cross-section and extend toward each other from their respective upper and lower braces 26, 28. The generally circular cross-section of the upper and lower reinforcing braces 26, 28 and the upper and lower reinforcing ribs 30, 32 have a diameter "$d_r$" and a radius "$r_r$" which is half of the diameter dr As the upper and lower reinforcing ribs 30, 32 begin to meet, they curve outwardly to commence formation of the article supporting portion 14 as will be hereinafter more fully described. The diameter $d_r$ is sized to provide the advantageous strength and flexibility features of the present invention.

Figure 5:
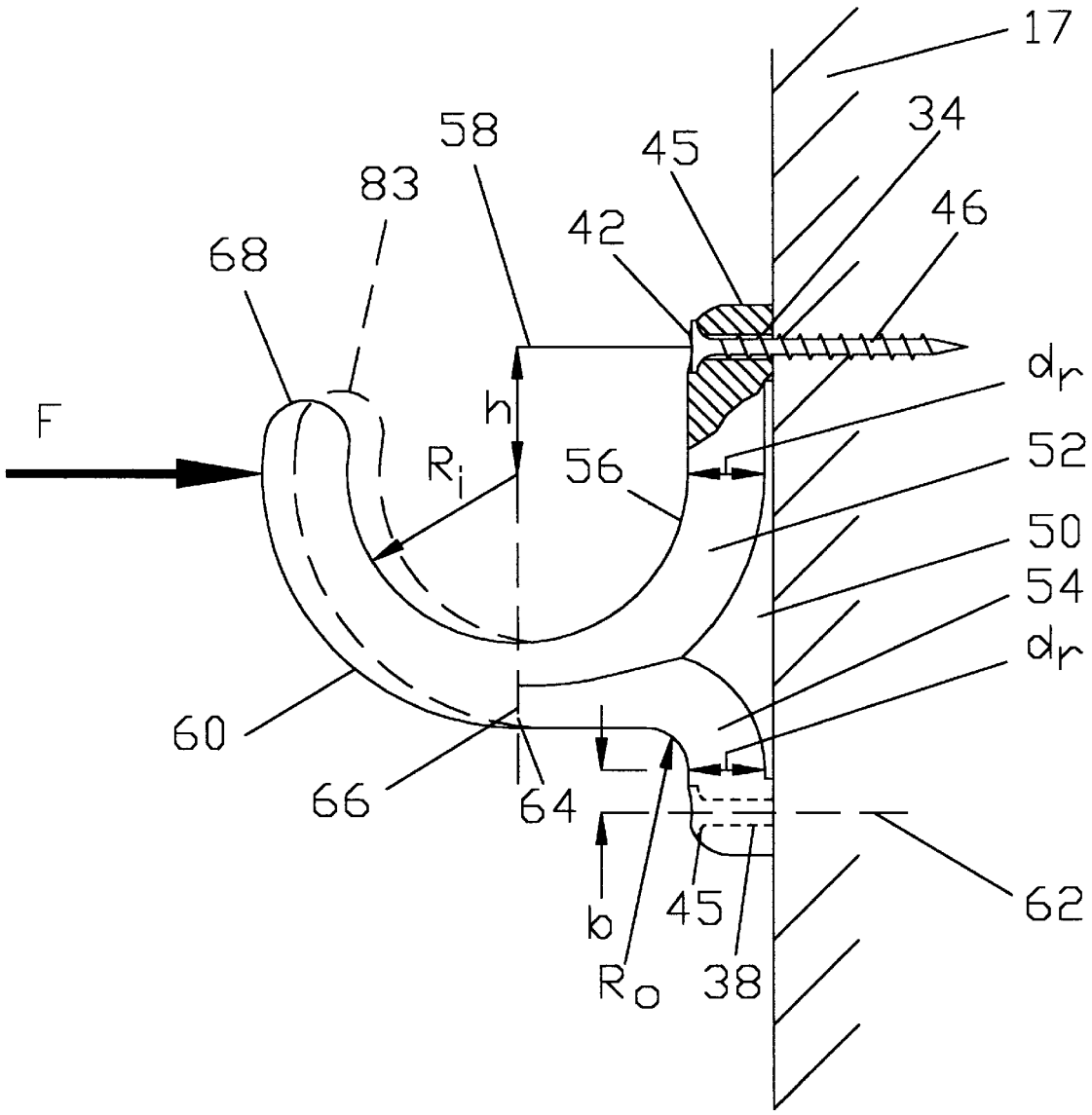
FIG. 5 is a partial sectional right side elevational view of the hook shown in FIG. 1.

The base portion 12 has a web 50 extending between the upper and lower base reinforcing braces 26, 28, and the upper and lower reinforcing ribs 30, 32 and define the central support surface 24. The web 50 is provided to strengthen the base portion 12. The article supporting portion 14 is formed by the converging portions 52, 54 of the upper and lower reinforcing ribs 30, 32 respectively, as seen in FIGS. 1 and 5. The upper reinforcing rib 30 describes a portion of the inner hook surface 56 and is formed about a radius Ri positioned a distance h vertically downwardly of the center line 58 of the upper aperture 34. The balance of the inner hook surface 56 is described by the support and the retaining portions 14, 16 respectively. The lower reinforcing rib 32 describes a portion of the outer hook surface 60 and is formed about a radius Ro positioned a distance b vertically upwardly of the center line 62 of the lower aperture 38. The lower reinforcing rib 32 extends horizontally outwardly in a direction substantially vertical to the support surface 18 until it completely joins the upper reinforcing rib 30 at the outer end 64 of the article supporting portion 14.

The article supporting portion 14 terminates in the outer end 64 thereof where the upper and lower reinforcing ribs 30, 32 of the article supporting portion 14 completely join to have a diameter of $d_r$. The outer end 64 of the article supporting portion 14 is the place where the article supporting portion 14 joins the article retaining portion 16 and is vertically in alignment with the center of the radius Ro. The distances h and b and radii Ri and Ro are such that the outer end 64 of the article supporting portion 14 has a circular cross section having a diameter of $d_r$. The radius Ri is substantially greater than the radius Ro. The radius Ri is large enough to provide sufficient space between the base 12 and the article retaining portion 16 for an article to fit on the inner hook surface 56 and provide sufficient size of the article retaining portion to flex and achieve the features of the present invention This design of the article supporting portion 14 provides improved resistance to a bending force in the vertical direction for supporting an article 15 thereon as will hereinafter be more fully described.

The hook 10 of the present invention has the article retaining portion 16 extending generally upwardly from the article supporting portion 14 and operates to keep the article 15 on the article supporting portion. The retaining portion 16 has an inner end 66 which is adjacent to and formed integrally with the outer end 64 of the article retaining portion 14. The article retaining portion 16 has a circular cross section having a diameter $d_r$ and is formed in a semi circular shape about the radius Ri. and is curved upwardly to its outer end 68. The outer end 68 is formed in a rounded shape having a radius $r_i$.. The article support portion 14 and the article retaining portion 16 defines portions of the inner hook surface 56 and outer hook surface 60.

The rounded sections of all of the inner and outer surfaces 56, 60 of the hook 10 are particularly desirable since they deflect impact forces and deflect the movement of the hook. The upper and lower reinforcing braces 26, 28, the upper and lower reinforcing ribs 30, 32, the article supporting portion 14, and the article retaining portion 16 all have rounded edges as described above so the inner and outer surfaces 56, 60 of the hook 10 are rounded. In addition by using the same diameters for the upper and lower reinforcing braces 26, 28, the upper and lower reinforcing ribs 30, 32, and the article retaining portion 16, more uniform cross sections are achieved and allows the hook to be more readily formed by injection molding.

While the hook 10 of the present invention has been described herein in connection with the base portion or mounting means 12, article supporting portion or article supporting means 14, and the article retaining portion or article retaining means 16, it should be understood that the hook 10 may be made in a variety of different constructions and designs.

Two properties of the hook 10 of the present invention are important to its proper design and operation. First, the material from which the hook 10 is formed must have the ability to readily to deform without permanent damage and to substantially recover to its original shape when unloaded while having sufficient strength to hold an article when shaped in accordance with the present invention.. Secondly, the geometry of the hook 10 must provide acceptable stiffness during normal operation to support a load applied to the article supporting portion and simultaneously have the acceptable flexibility of the article retaining portion during accidental impact loading to minimize injury.

In order to better understand these properties of the present invention, a simplified mathematical analysis shows the relationship between the material properties and physical design characteristics to achieve the desirable features of the present invention. While a simplified analysis does not describe in exact detail all of the relationships between the material properties and physical design characteristics of the present invention, it does give an indication between certain relationships.

For purposes of this simplified analysis, the base portion 12 will be considered as being fixed to the wall 17 and rigid. Any flexing of the base portion 12 is minimized by the strengthening effect of the upper and lower outer reinforcing portions or ribs 30, 32, the fasteners 42 and their interconnection.

In order to discuss the cross sectional configuration of various sections shown in FIGS. 6–9 of the article supporting portion 14 of the hook 10, it is important to understand certain relationships concerning the geometry of the hook of the present invention. When considering the article supporting portion 14 as a beam, the beam has a neutral axis which is generally the center of gravity of the cross section of the beam when the material of the beam is in the same tension and compressive stress. When a force is exerted on a beam tending to bend the beam and creating a bending moment, the stress at the neutral axis is zero. As described further hereinbelow, if the amount of material of the beam in tensile stress exceeds the amount of material in compressive stress, the neutral axis will shift. It is believed that this principal contributes to the novel features of the present invention.

The moment of inertia quantitatively describes in part the stiffness of a beam to resist a force tending to bend the beam or bending moment and is discussed below in connection with a beam having equal parts of the beam in tension and compression. This moment of inertia is directly proportional to the square of the distance, herein referred to as "distance d", from the neutral axis of the beam to the center of gravity of the portion of the cross section of the beam either above or below the neutral axis. The moment of inertia is also directly proportional to the area of the portion of the beam either above or below the neutral axis. Since the moment of inertia is directly proportional to the square of the distance d, the stiffness of the beam tending to resist bending forces is dramatically improved by increasing the distance d from the center of gravity of the beam. In addition, it can be seen that the ability of a beam to resist bending forces increases as the cross sectional area of the beam increases so that beams with larger cross sections have a greater resistance to bending forces.

Figure 6:
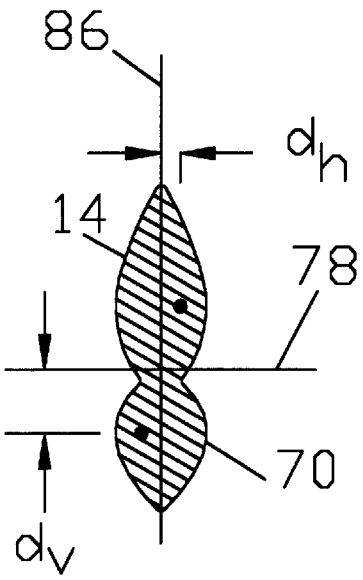
FIG. 6 is a sectional view of the hook shown in FIG. 1 and taken along lines A—A thereof.
Figure 7:
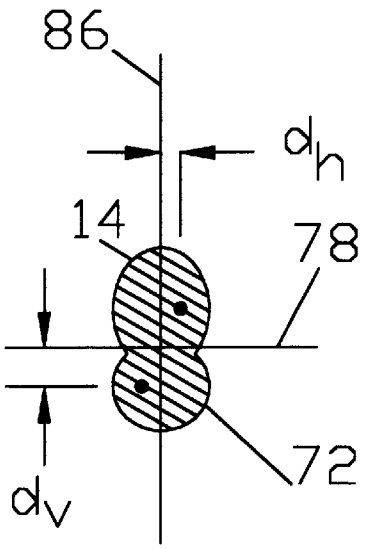
FIG. 7 is a sectional view of the hook shown in FIG. 1 and taken along lines B—B thereof
Figure 8:
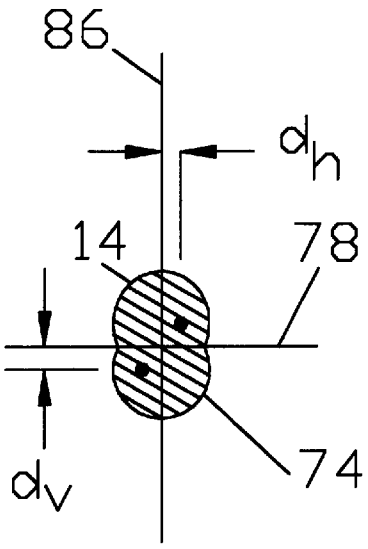
FIG. 8 is a sectional view of the hook shown in FIG. 1 and taken along lines C—C thereof.
Figure 9:
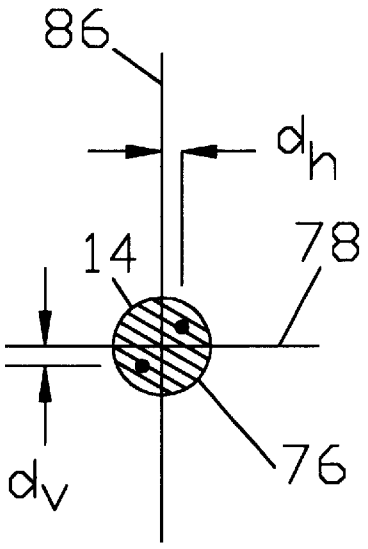
FIG. 9 is a sectional view of the hook shown in FIG. 1 and taken along lines D—D thereof.

The hook of the present invention provides an article supporting portion 14 with improved resistance to a bending force in the vertical direction to support an article 15. FIGS. 6–9 show the cross sections of the article supporting portion 14 along the corresponding section lines A—A, B—B, C—C and D—D shown in FIG. 1. The article supporting portion 14 has a base section 70 or section A located at the inner end 71 of the support portion 14, as seen in FIGS. 1 and 6. The base section 70 is adjacent the base portion 12 where the article supporting portion 14 joins with and begins to extend from the base portion. The article supporting portion 14 has other intermediate sections B, indicated at 72, and C, indicated at 74 as shown in FIGS. 7 and 8 respectively, and an outer section D, indicated at 76 as shown in FIG. 9. All of the sections B, C, and D are positioned outwardly of the base section A as shown in FIG. 1. The section B is located a distance from the base section 16, the section C is located a greater distance from the base section, and the outer section D is located at the outer end 64 of the article supporting portion 14 where the article supporting portion joins the article retaining portion 16.

The base section A, shown in FIG. 6 is designed to have a vertical moment of inertia greater than the vertical moment of inertia of the intermediate sections B or C or the outer section D. For purposes of this description, the vertical moment of inertia is the moment of inertia to resist vertical forces and the horizontal moment of inertia is the moment of inertia to resist sideways forces on the hook as will be herein more fully described. The vertical moment of inertia of the section B is greater than the vertical moment of inertia of the section C, and the vertical moment of inertia of the section C is greater than the vertical moment of inertia of the section D.

In such a design of the article supporting portion 14, it should be understood that the weight of the article 15 is generally positioned about the outer end 64 of the article supporting portion 14, or section D. As a result of this loading, the bending moment exerted on the base section A is greater than the bending moment exerted on the other sections B, C, or D with practically no bending moment exerted on section D. As shown in FIGS. 6–9, the distance $d_v$ is the distance from the neutral axis 78 of the article supporting portion 14 to the center of gravity of the portion of the cross section of the article supporting portion either above or below the neutral axis. The distance $d_v$ of the vertical moment of inertia of section A is greater than the distance $d_v$ of the vertical moment of inertia of section B, C, or D. This factor has the effect of being substantially the square of the distance $d_v$ and has a dramatic effect on the vertical moment of inertia.

Also, the area of the vertical moment of inertia of the section A portion of the article supporting portion 14 either above or below the neutral axis 78 is greater than the area of the vertical moment of inertia of either sections B, C, or D of the beam either above or below the neutral axis. Likewise, this same relationship is true between sections B and C and also sections C and D. The curved shape of the upper and lower reinforcing ribs 30, 32 contribute to this physical stiffness since they provide for increasing both the distance d and the area either above or below the neutral axis 78 while allowing a smaller interconnecting portion around the neutral axis.

By so designing a beam with a moment of inertia that increases progressively closer to the base section A, an article retaining portion 14 can be designed to have substantially the same stress along the article retaining portion for loads supported as described. Since the bending moment and vertical stiffness at the base section A is greater than at sections B, C, or D, the bending moment and vertical stiffness at section B is greater than at sections C or D, and the bending moment and vertical stiffness at section C is greater than the bending moment and vertical stiffness at section D, the moment of inertia of each of the sections A, B, C, and D are designed so that the stress on each of those sections are substantially equal. By so designing the physical properties of the article retaining portion 14, the article retaining portion can support the weight of an article as described herein. It should be recognized that it may be desirable to have a slightly higher stress in the outer end 64 to allow some flexing of the outer end 64 of the article support portion 14 upon impact.

Figure 10:
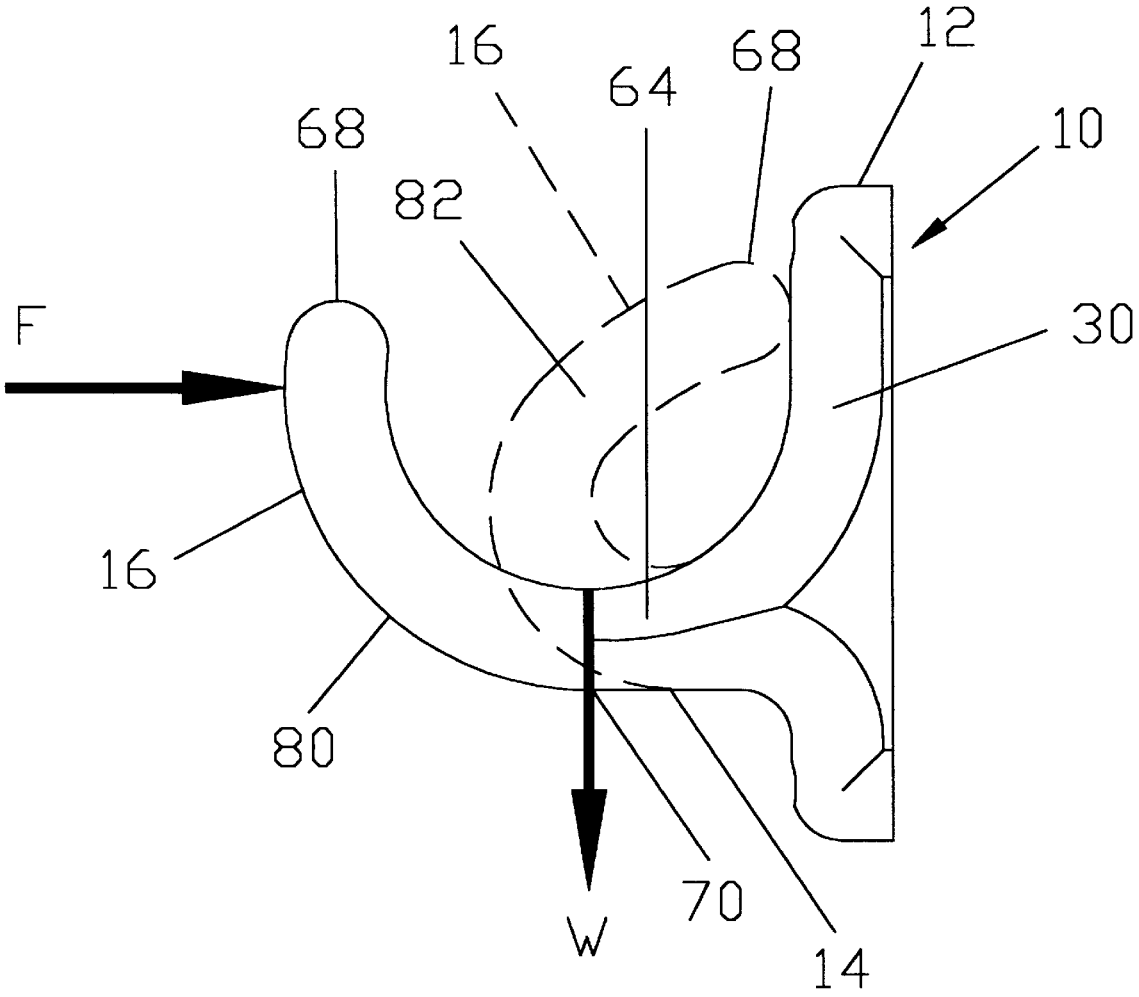
FIG. 10 is a right side elevational view of the hook shown in FIG. 1 showing deflection of the hook.

On the other hand, when a large impact force is exerted on the article retaining portion 16 as indicated by the arrow F in FIG. 10, with the weight of the article 15 indicated by the arrow W, the article retaining portion 16 moves from its original position 80, shown in solid lines, to an impacted position 82 indicated by dashed lines. In the impacted position 82, there is some small amount of movement of the article retaining portion 14 around the area of the outer end 68 and outer section 70 but due to the combination of physical and material properties of the article retaining portion, such movement is minimal and the article 15 is retained on the hook. In such an extreme condition, the outer end 68 of the article retaining portion 16 contacts the upper reinforcing rib 30 of the base portion 12 and such contact resists further movement of the article retaining portion.

As shown in FIG. 5, when the impact force F is small, the deflection of the article retaining portion 15 is small as indicated by the position 83 in dashed lines.

The hook 10 is also designed to allow the hook to have some flexibility in the horizontal direction so that when the hook is impacted or brushed from the side, that it will flex and then return to its original position. Such an impact force may be in a direction indicated in FIG. 3 by the arrow "S" which is vertical to the plane 84 or a plane parallel thereto in which the base 12, supporting portion 14 and retaining portion 16 lie. The plane 84 is substantially perpendicular to the plane 19 of the wall 17.

The article supporting portion 14 is designed to provide this desirable feature by providing a horizontal moment of inertia that is less than the vertical moment of inertia at each of its sections A, B and C. While the article supporting portion 14 is stiffer in the horizontal direction at its inner end 71 base section A or 70 than at its outer portion 64, it is not as stiff as the vertical moment of inertia at each of its respective sections.

For purposes of this description, the horizontal moment of inertia is the moment of inertia to resist sideways forces on the hook 10 vertical to the plane 84 of the base, article supporting and retaining sections, 14, 16, such as when a person or horse is moving along the wall the hook is mounted on and hits the hook.

As shown in FIGS. 6–9, the base section A or 70 is designed to have a horizontal moment of inertia greater than the moment of inertia of the intermediate sections B and C or the outer section D. The horizontal moment of inertia of the section B or 72 is at least equal to and preferably greater than the horizontal moment of inertia of the section C or 74, and the horizontal moment of inertia of the section C is at least equal to and preferably greater than the horizontal moment of inertia of the section D or 76. The horizontal moment of inertia of the base section 70 is less than the vertical moment of inertia of the base section 70. Likewise, the horizontal moment of inertia of the section 72 is less than its vertical moment of inertia, the horizontal moment of inertia of the section 74 is less than its vertical moment of inertia, and the horizontal moment of inertia of the section 76 is the substantially the same as its vertical moment of inertia..

In such a design of the article supporting portion 14, the horizontal bending moment exerted on the base section A is greater than the horizontal bending moment exerted on the other sections B, C, or D since the hook 10 is hit horizontally usually a distance from these sections. Generally such a horizontal impacting force is exerted on the retaining portion 16. When the horizontal impacting force S is exerted on the retaining portion 16, the bending moments at the sections B are greater than the bending moments at section C and the bending moments at the sections C are greater than the bending moments at section D. The horizontal sideways force S exerted on the end section D or on the article retaining portion 16 and, with respect to the article supporting portion, exerts a greater bending moment on the base section A and successively less in the sections B, C, and D as the sections move outward of the base section A As shown in FIGS. 6–9, the distance $d_h$ is the distance from the neutral axis 86 of the article supporting portion 14 to the center of gravity of the portion of the cross section of the article supporting portion either above or below the neutral axis. The distance $d_h$ of the horizontal moment of inertia of sections A, B, C and D are substantially equal. Accordingly, the squared factor of the distance $d_h$ does not meaningfully, if at all, increase the horizontal moment of inertia of the article support portion 14.

The area of the horizontal moment of inertia of the section A portion of the support portion 16 either above or below the neutral axis 86 is somewhat greater than the area of the horizontal moment of inertia of either sections B, C, or D of the article supporting portion 14 either above or below the neutral axis 86. Likewise, this same relationship is true between sections B and C and also sections C and D. The horizontal moment of inertia is slightly greater at the base section A and to a lesser extent at the section B and yet lesser extent at the section C and even lesser extent at section D as a result of greater areas on either side the neutral axis 86. Accordingly, the article support portion can flex more readily in the horizontal direction. Such a design allows for loads to be supported by the article supporting portion 14 while allowing for movement of the article supporting portion in a horizontal direction upon impact.

The material forming the hook 10 of the present invention also has specific properties to achieve the advantageous features of the present invention. The following illustrative formulas are provided to describe the general interdependence of the structural and material properties of a hook 10 made in accordance with the present invention. The article supporting portion 14 may be viewed as a cantilever beam for purposes of considering the relationships of some of its physical and material characteristics. The following formula describes some the structural and material characteristics of a cantilevered beam of uniform cross section having a Moment of Inertia of I and a load P exerted on the beam a distance L from the body from which it is cantilevered. When the load P is initially exerted on the beam, the beam deflects a distance δ. The relationship between the structural stiffness, δ and P is expressed by the formula:

$$P=[3EI/L^3]\delta \text{ and } \delta=P[L^3/EI]$$

The structural stiffness is $[3EI/L^3]$, and the material stiffness or modulus of elasticity of the material is E. As will be more fully described hereinafter, the modulus of elasticity is the slope of a stress-strain curve as is known in the art. As can be seen from the above formula, when the beam has greater structural stiffness, the beam does not deflect as much as when the same load is applied. Also, when the material has a lower modulus of elasticity, it will deflect more than when the modulus of elasticity of the material is higher.

Psi is a known abbreviation for pounds per square inch. The term "stress" is defined as load per unit area and is generally expressed in "psi" (pounds per square inch). The term "strain" is defined as change in length per unit length and is unitless being length divided by length. The term "percent" strain is the strain magnitude expressed as a percentage instead of as a decimal number (change in length per unit length). Modulus of Elasticity where it is defined as "the slope of the stress-strain curve up to the proportional limit". The terms "yielding curve" and "stiffening curve" and identifies the behavior of a materials stress stain curve as deviations from straight line behavior. This specification defines the "yielding curve" as having strains larger than that predicted by a straight line, for stresses above a certain prescribed limit and the "yielding" curve is also explained when the material is in compression. This specification also defines a "stiffening curve" having strains less than that predicted by a straight line, for stresses above a certain prescribed limit. In summary, these alternative stress strain curves exhibit behaviors that fall on opposite sides of the straight line prediction.

Within the operating range of stress and strain anticipated by the present invention, the material used to provide the hook of the present invention has a modulus of elasticity "E" that decreases in tension after a predetermined amount of stress or strain, and remains the same or increases in compression after a predetermined amount of stress or strain. Most structural materials do not behave this way and have a "yielding curve" in both tension and compression. Generally, the stress strain curve for a structural material in tension is substantially linear for lower stresses and as the stress increases passed a point, the strains are greater than that predicted from a straight line defined by the lower stress strain curve. Such a curve will be referred to as a "yielding" curve. Conversely, the stress strain curve for most structural materials in compression is substantially linear for lower compressive stresses up to a point and as the compressive stress increases past that point, the compressive strains are greater than that predicted from a straight line of the initial stress strain curve whose slope defines the initial modulus of elasticity.. Such a curve will hereinafter also be referred to as a "yielding curve". A "stiffening curve" occurs when, for example, the material is in compression and as the compressive stress is increased past a point, the compressive strains are less than that predicted from a straight line of the initial stress strain curve.

The material used to provide the hook of the present invention preferably has a modulus of elasticity "E" that decreases in tension after a predetermined amount of stress or strain, or in other words has a yielding curve in tension, and remains the same or increases in compression after a predetermined amount of stress or strain, or in other words has a straight line or stiffening curve in compression within the working range of the stresses in the hook. When the hook made from such a material is impacted, the material of the hook in tension stretches and yields while the material of the hook in compression remains the same stiffness or becomes more stiff.

Figure 11:
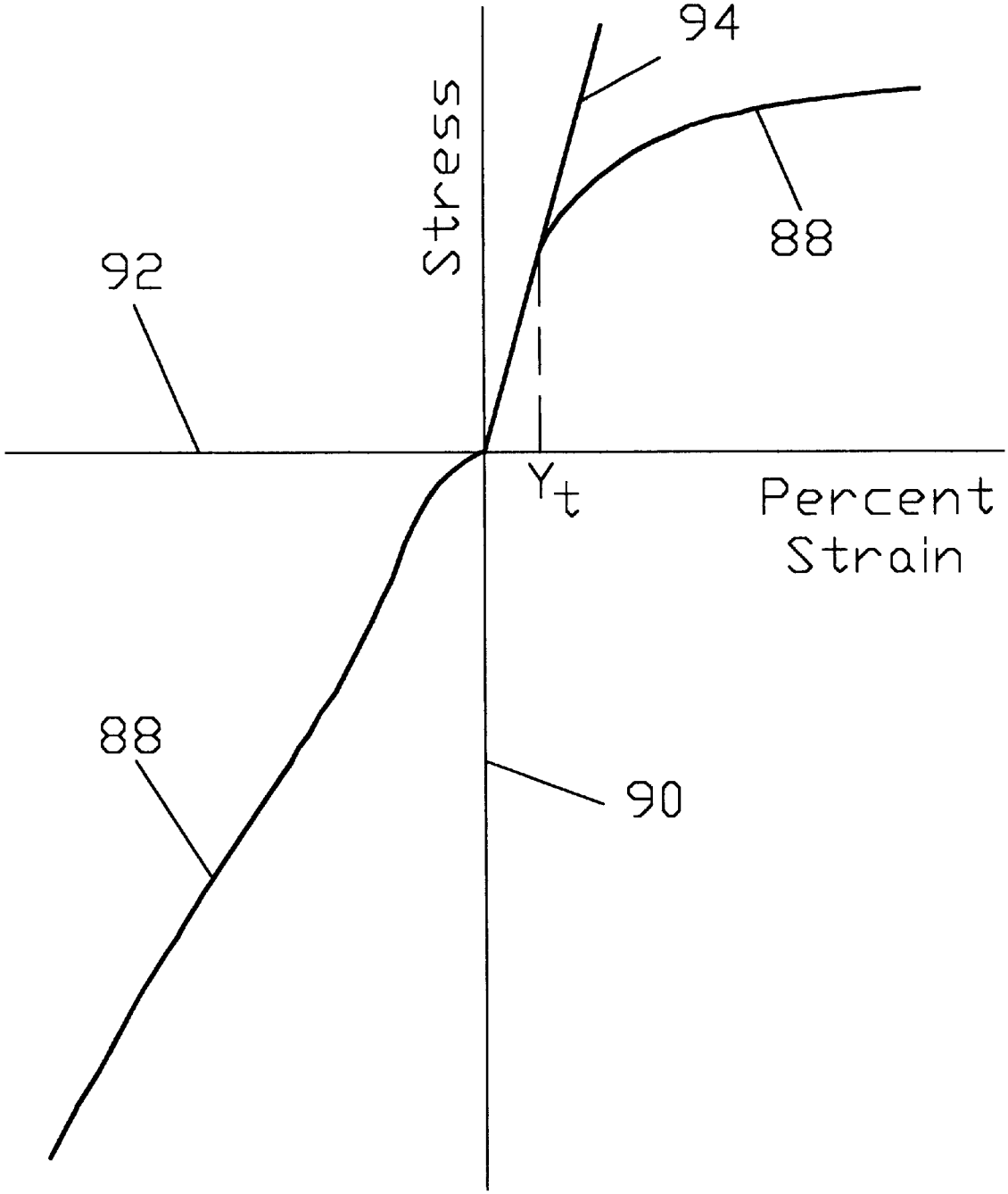
FIG. 11 is a representative stress strain curve of the material used to make the hook of the present invention.

A stress strain curve 88 that is characteristic of one material used to form the hook of the present invention is shown in FIG. 11. The vertical axis 90 of this graph is the stress and the horizontal axis 92 is the percent strain in the material. In tension, where both the stress and strain are positive, the modulus of elasticity of the material initially is essentially linear and follows the line 94. The slope of the line 94 is the initial modulus of elasticity of the material in tension. After a point where the strain reaches $Y_t$, as the stress increases the strains are greater than that predicted from the straight line 94 and the material has a yielding curve in tension. Also, the modulus of elasticity "E" decreases in tension after the strain exceeds $Y_t$, also characteristic of a yielding curve in tension.

Some materials are believed to have a different modulus in tension than in compression, even in the initial region near the origin. For such materials, the initial slope of the stress strain curve is often determined from a bending experiment where one side of the material is in tension while the other is in compression. The modulus determined from such a test effectively averages the tension and compression modulii that would be measured separately from tension and compression tests. Such a material could be used for this application, so long as the material exhibited a yielding curve in tension and a linear or stiffening curve in compression with a shifting neutral axis during excessive bending.

In compression, where both the stress and strain are negative, the modulus of elasticity of the material is substantially linear, after an initial load up region, and follows the curve 88 in compression. The slope of the curve 88 is the modulus of elasticity of the material. In other materials having stiffening curves in compression, as the stress continues to increase, the strains are less than that predicted from a straight line defining the initial modulus of elasticity in compression and the material has a stiffening curve in compression. Also, in such a material, the modulus of elasticity "E" increases in tension after the strain exceeds its compressive yield point, characteristic of a stiffening curve in compression.

This characteristic of the material used to provide the hook 10 of the present invention allows the article retaining portion 16 and the article support portion 14 to flex when an impact force is exerted on the article retaining portion or the article support portion. This favorable feature of the present invention can be best understood by considering a beam of uniform cross-section having a bending moment exerted thereon. As long as the strain exerted on the beam by the bending moment is within the linear portion of the stress strain curve, the neutral axis of the beam is at the center of the beam and both the tensile and compressive stresses are equal. It is important to understand that the neutral axis of the beam is established by the amount of stress above the neutral axis being equal to the amount of stress below the neutral axis.

When the bending moment on the beam exceeds the predetermined limit on the stress strain curve in tension, a greater amount of tensile strain than anticipated by the linear portion of the tensile stress strain curve will be realized. On the other hand, when the bending moment on the beam exceeds the predetermined limit of the stress strain curve in compression, a lesser or equal amount of compressive strain than that anticipated by the linear portion of the compressive side of the stress strain curve will be realized. When considering the balancing of the amount of the material in compression being equal to the amount of material in tension, the neutral axis of the beam shifts towards the area in compression leaving more material in tension to allow the beam to flex. As the impact force increases, the hook 10 continues to flex and the neutral axis 78 continues to move towards the portion of the beam in compression. Accordingly, when there is a high impact force, the amount of the beam in compression is small because the modulus of elasticity of the material in compression remains constant or increases. In this condition, the amount of the material in tension is large since the tensile modulus of elasticity decreases and a greater amount of material is required to withstand that high impact force in tension. This characteristic occurs with a material having a yielding curve in tension and a linear or stiffening curve in compression.

This material exhibits time varying properties at room temperature, common to many plastics and rubber like materials. During normal use, the material of the article supporting portion 14 of the hook 10 responds in the low stress-low strain region where the displacements do not accumulate with time. When the hook is accidentally impacted at the article retaining portion 16, the material behavior responds in the large strain region allowing large displacements for a short time period, without high stresses and resistance loads. This temporary flexibility provides the desired safety feature while rendering the hook undamaged during such an accident. After such an accident, the hook returns to substantially the original shape ready to continue serving as an article supporting device or hook 10.

The material to form the hook 10 of the present invention has a yielding curve in tension and a substantially linear or stiffening curve in compression, after a small initial loading over the practical operating stress ranges of the hook 10. This material is formulated to preferably have an initial modulus of elasticity of from between about 4,500 psi to 6,500 psi which initial modulus of elasticity is generally linear up to about 5% strain in tension and an initial modulus of elasticity in compression of from between about 2,500 psi to 5,000 psi which initial modulus of elasticity is generally linear up to about 5% strain in compression. With increasing compressive strains above about 5% to about 50%, the material has a substantially linear or stiffening curve. It has been found that by varying the physical dimensions of the hook 10 within practical design considerations, the material may be formulated so the range of the initial modulus of elasticity in tension ranges between about 2,000 psi to about 40,000 psi in the range of strain in tension up to about 5% while the initial modulus of elasticity in compression ranges between about 1,000 psi to about 40,000 psi in the range of strain in compression up to about 5%.

The preferred embodiment of the invention is formed from thermoplastic rubber sold under the trademark VYRAM™ further designated as VYRAM™ rubber 9101-85, manufactured by Advanced Elastomer Systems. When injection molded, this material has a Shore A hardness (5 second) of typically 85 using the TPE 0169 (ASTM D 2240) test method; and an ultimate tensile strength of 1300 psi, ultimate elongation of 700 percent and 100% modulus of 800 psi using the ASTM D 412 testing method; and a 22 hour compression set of 36% at 70° C. (158° F.) using the ASTM D395, Method B testing Method (TPE-0016). Other materials having the desired stress strain curve and initial modulus of elasticity have also been used to make the hook of the present invention.

The invention has been described with reference to the preferred embodiments. Obviously, modifications and alterations will occur to others upon reading and understanding this specification it is my intention to include all modifications and alterations insofar as they, within the scope of the appended claims or equivalents thereof.

Having described my invention, I claim:

1. A hook for supporting an article having a base portion for mounting said hook, an article supporting portion extending from said base portion for supporting an article thereon, an article retaining portion extending generally upwardly and outwardly from said article supporting portion, said article retaining portion, said base portion and said article supporting portion formed as solid integral portions from a material having an initial modulus of elasticity in tension of from between about 2,000 psi to about 40,000 psi up to about 5% strain in tension and an initial modulus of elasticity in compression of from between about 1,000 psi to about 40,000 psi up to about 5% strain in compression, said article supporting portion having a base section adjacent said base portion and an outer section adjacent said article retaining portion, said base section having a greater vertical moment of inertia than the vertical moment of inertia of said outer section, said base section having a vertical moment of inertia greater than the horizontal moment of inertia of said base section whereby said article retaining portion is flexible and resiliently deformable in all directions so that when said hook is impacted, it can flex and decrease the possibility of injury and whereby said hook will return substantially to its original shape.

2. A hook for supporting an article as described in claim 1 made from a material having a stress strain curve that is yielding in tension and in compression a straight or stiffening curve.

3. A hook for supporting an article as described in claim 1 wherein said article supporting portion has a base section adjacent said base portion and an outer section adjacent said article retaining portion, said base section having a greater horizontal moment of inertia than the horizontal moment of inertia of said outer section.

4. A hook for supporting an article as described in claim 1 wherein said article supporting portion has a base section adjacent said base portion, said base section having a vertical moment of inertia greater than the horizontal moment of inertia of said base section.

5. A hook for supporting an article as described in claim 1 made from a thermoplastic rubber material having a Shore A hardness (5 second) of typically 85 using the TPE 0169 (ASTM D 2240) test method; and an ultimate tensile strength of 1300 psi, ultimate elongation of 700 percent and 100% modulus of 800 psi using the ASTM D 412 testing method; and a 22 hour compression set of 36% at 70° C. (158° F.) using the ASTM D395, Method B testing Method (TPE-0016).

6. A hook for supporting an article as described in claim 1 wherein said article supporting portion has a greater structural stiffness than the structural stiffness of said article retaining portion.

7. A hook for supporting an article as described in claim 1 wherein said article supporting portion has an outer section adjacent said article retaining portion, said outer section having a horizontal moment of inertia substantially the same as its vertical moment of inertia.

8. A hook for supporting an article as described in claim 1 wherein said article supporting portion has a first and a second section positioned between said base section and said outer section, said second section positioned a greater distance from said base section than said first section, said first section having a vertical moment of inertia greater than the vertical moment of inertia of said second section.

9. A hook for supporting an article as described in claim 1 wherein said article supporting portion has a geometric configuration with substantially the same stress along its length when a vertical load is exerted on said outer section of said article supporting portion.

10. A hook for supporting an article having a base portion for mounting said hook, an article supporting portion extending from said base portion for supporting an article thereon, said article portion having a base section adjacent said base portion and terminating in an outer section, said article supporting portion formed from upper and lower reinforcing ribs extending from said base portion where they are spaced from each other and are positioned closer to each other as they extend toward said outer section, an article retaining portion extending generally upwardly and outwardly from said article supporting portion, said article retaining portion and said article supporting portion formed from a material having an initial modulus of elasticity in tension of from between about 2,000 psi to about 40,000 psi up to about 5% strain in tension and an initial modulus of elasticity in compression of from between about 1,000 psi to about 40,000 psi up to about 5% strain in compression whereby said article retaining portion is flexible and resiliently deformable in all directions so that when said hook is impacted, it can flex and decrease the possibility of injury and whereby said hook will return substantially to its original shape.

11. A hook for supporting an article as described in claim 10 wherein said reinforcing ribs have a substantially round cross section.

12. A hook for supporting an article as described in claim 10 wherein said reinforcing ribs are joined at said outer section.

13. A hook for supporting an article as described in claim 10 wherein said article retaining portion has a substantially round cross section.

14. A hook for supporting an article as described in claim 10 made from a material having a stress strain curve that is yielding in tension and in compression a straight or stiffening curve.

15. A hook for supporting an article as described in claim 10 made from a thermoplastic rubber material having a Shore A hardness (5 second) of typically 85 using the TPE 1069 (ASTM D 2240) test method, and an ultimate tensile strength of 1300 psi, ultimate elongation of 700 percent and 100% modulus of 800 psi using the ASTM D 412 testing method; and a 22 hour compression set of 36% at 70° C. (158° F.) using the ASTM D395, Method B testing Method (TPE-0016).

16. A hook for supporting an article as described in claim 10 wherein said article supporting portion has a greater structural stiffness than the structural stiffness of said article retaining portion.

17. A hook for supporting an article as described in claim 10 wherein said base section has a greater vertical moment of inertia than the vertical moment of inertia of said outer section.

18. A hook for supporting an article as described in claim 17 wherein said article supporting portion has a first and a second section positioned between said base section and said outer section, said second section positioned a greater distance from said base section than said first section, said first section having a vertical moment of inertia greater than the vertical moment of inertia of said second section.

19. A hook for supporting an article as described in claim 17 wherein said article supporting portion has a geometric configuration with substantially the same stress along its length when a vertical load is exerted on said outer section of said article supporting portion.

20. A hook for supporting an article as described in claim 10 wherein said base section has a greater horizontal moment of inertia than the horizontal moment of inertia of said outer section.

21. A hook for supporting an article as described in claim 10 wherein said base section has a vertical moment of inertia greater than the horizontal moment of inertia of said base section.

22. A hook for supporting an article as described in claim 10 wherein outer section is adjacent said article retaining portion, said outer section having a horizontal moment of inertia substantially the same as its vertical moment of inertia.

23. A hook for supporting an article on a structure having means for mounting said hook to the structure, means for supporting the article, said article supporting means extending from said mounting means and means for retaining the article on said article supporting means, said article retaining means extending upwardly and outwardly from said article supporting means, said article retaining means and said article supporting means formed as solid integral portions from a material having an initial modulus of elasticity in tension of from between about 2,000 psi to about 40,000 psi up to about 5% strain in tension and an initial modulus of elasticity in compression of from between about 2,000 psi to about 40,000 psi up to about 5% strain in compression, said article supporting means having a base section adjacent said base portion and an outer section adjacent said article retaining means, said base section having a greater vertical moment of inertia than the vertical moment of inertia of said outer section, and said base section having a vertical moment of inertia greater than the horizontal moment of inertia of said base section whereby said article retaining portion is flexible and resiliently deformable in all directions so that when said hook is impacted, it can flex and decrease the possibility of injury and whereby said hook will return substantially to its original shape.

24. A hook for supporting an article as described in claim 23 made from a material having a stress strain curve that is yielding in tension and in compression a straight or stiffening curve.

25. A hook for supporting an article as described in claim 23 made from a thermoplastic rubber material having a Shore A hardness (5 second) of typically 85 using the TPE 1069 (ASTM D 2240) test method; and an ultimate tensile strength of 1300 psi, ultimate elongation of 700 percent and 100% modulus of 800 psi using the ASTM D 412 testing method; and a 22 hour compression set of 36% at 70° C. (158° F.) using the ASTM D395, Method B testing Method (TPE-0016).

26. A hook for supporting an article as described in claim 23 wherein said article supporting means has a geometric configuration with substantially the same stress along its length when a vertical load is exerted on said outer section of said article supporting means.

27. A hook for supporting an article as described in claim 23 wherein said article supporting means has a base section adjacent said mounting means and an outer section adjacent said article retaining means, said base section having a greater horizontal moment of inertia than the horizontal moment of inertia of said outer section.

28. A hook for supporting an article as described in claim 23 wherein said article supporting means has an outer section adjacent said article retaining means, said outer section having a horizontal moment of inertia substantially the same as its vertical moment of inertia.

* * * * *